United States Patent [19]

Nakamura

[11] Patent Number: 4,608,209

[45] Date of Patent: Aug. 26, 1986

[54] CARBURETER FOR INTERNAL COMBUSTION ENGINE

[75] Inventor: Shigeyoshi Nakamura, Odawara, Japan

[73] Assignee: Mikuni Kogyo Kabushiki Kaisha, Tokyo, Japan

[21] Appl. No.: 759,893

[22] Filed: Jul. 29, 1985

[30] Foreign Application Priority Data

Jul. 31, 1984 [JP] Japan ..... 59-116176[U]
Sep. 20, 1984 [JP] Japan ..... 59-141655[U]

[51] Int. Cl.[4] ..... F02M 17/40

[52] U.S. Cl. ..... 261/64 E; 261/65; 285/114; 285/363

[58] Field of Search ..... 261/65, 64 E; 285/114, 285/363

[56] References Cited

U.S. PATENT DOCUMENTS

| | | | |
|---|---|---|---|
| 3,400,952 | 9/1968 | Swenson et al. | 285/114 |
| 3,671,208 | 6/1972 | Medsker | 261/DIG. 65 |
| 3,866,953 | 2/1975 | Thastrup | 285/114 |
| 4,109,941 | 8/1978 | Wood et al. | 285/114 |
| 4,193,948 | 3/1980 | Charmley et al. | 261/DIG. 65 |
| 4,406,467 | 9/1983 | Buger et al. | 285/363 |
| 4,414,163 | 11/1983 | Barr et al. | 261/DIG. 68 |

FOREIGN PATENT DOCUMENTS

| | | |
|---|---|---|
| 49-39710 | 10/1974 | Japan . |
| 51-134125 | 10/1976 | Japan . |
| 54-19454 | 7/1979 | Japan . |
| 58-33252 | 7/1983 | Japan . |
| 59-105948 | 6/1984 | Japan . |

*Primary Examiner*—Tim Miles
*Attorney, Agent, or Firm*—Lalos, Keegan & Kaye

[57] ABSTRACT

In order to enable a carbureter body formed of a soft material such as a synthetic resin to be coupled easily between an air cleaner and a manifold pipe in its state of not developing a distortion, the carbureter for an internal combustion engine comprises: reinforcing members each having a high rigidity and a length greater than the full length of the carbureter body but smaller than the length obtained by adding this length of the carbureter body to the thicknesses of two elastic sealing members used in coupling the carbureter body to the air cleaner and to the manifold pipe; a plurality of arms for nipping the reinforcing members in their posture of being placed along a suction bore of the carbureter body. Shaft-receiving bores for supporting a throttle valve shaft and a choke valve shaft are disposed at locations at which these valve shafts are not affected by the strains which are apt to develop when the carbureter body is coupled to the air cleaner and to the manifold pipe. Also, on the choke valve shaft and also in the inner faces of these shaft-receiving bores for supporting these valve shafts, means are provided so as to cooperate each other to semi-fix the valve.

11 Claims, 8 Drawing Figures

CARBURETER FOR INTERNAL COMBUSTION ENGINE

BACKGROUND OF THE INVENTION

1. Field of the invention

The present invention relates to a carbureter for an internal combustion engine, and more particularly it relates to a carbureter structure whose body is made of a soft material, and also to a structure for the attachment of the carbureter to the internal combustion engine.

2. Description of the prior art

As a system allowing an easy attachment of a carbureter to an internal combustion engine, there has been proposed in, for example, Japanese Utility Model Publication No. Sho 54-19454 an arrangement that the body of the carbureter is disposed between its upper-stream member and a lower-stream manifold pipe, and the body of carbureter is fixed by bolts as these bolts are passed through the three members. However, in case this known system is applied directly to a carbureter whose body is made of a soft material such as a synthetic resin, there arise such problems that leak occurs at the sealing sites due to stress relief (meaning the phenomenon that stress becomes weakened with time when strain is constant), or that the fastening bolts and nuts become loose. In order to solve these problems, there has been proposed a system to use reinforcing members having a length corresponding to the full length of the body of carbureter. It is, however, difficult from the practical point of view to make the total length of the carbureter body agree to the full length of the reinforcing member. In case the length of the reinforcing member is smaller than the length of the carbureter body, the reinforcing effect of these members will reduce substantially. Also, as disclosed in, for example, U.S. Pat. No. 4,414,163, such reinforcing members as mentioned above are passed through the bores which are provided in the flange portions (each sharing a same plane with its mating attachment end face) which, in turn, extend laterally from the end faces of the carbureter body intended for its attachment. According to this known carbureter-attaching method, the reinforcing members could easily come off, so that there is needed such an art of operation as forced inserting or caulking, with the result that there arises the problem that the attaching operation of a carbureter becomes considerably complicated and troublesome. Furthermore, since the opposite two attachment faces of the carbureter body and the entire faces of the flange portions are in direct contact with the attachment faces of both the manifold pipe and the air cleaner, there also has been the problem that it is not possible to prevent the occurrence of adverse effects of the heat of the engine upon the carbureter body made of a soft material. Also, in case the body of carbureter is made of a soft material such as a synthetic resin, there has arisen the problem that the fastening force of the inserted bolts tends to cause strains to the shaft-bearing bores which have been formed in the carbureter body to receive and support the choke valve shaft and the throttle valve shaft, and to develop deformations of the originally circular cross-section of the bores, with the result that the choke valve and/or the throttle valve develop impaired functions. Therefore, in the past, this problem has been solved by forming the shaft-bearing bores to have a somewhat larger diameter. This, however, has resulted in the development of a play on the part of the shafts which are passed therethrough, so that the choke valve and/or the throttle valve would rotate easily due to the vibrations caused, thus developing mal-functions.

SUMMARY OF THE INVENTION

It is, therefore, the principal object of the present invention to provide a carbureter having an attachment means which allows an easy operation of attaching the carbureter to an engine, and which does not cause degradation of the reinforcing effect exerted by the reinforcing members, once they have been attached to the carbureter body.

Another object of the present invention is to provide a carbureter having an attaching means which is capable of preventing the occurrence of surging at the surface of the oil contained in the float chamber due to vibrations of the system, and also of preventing adverse effects of the heat of the engine upon the carbureter body.

Still another object of the present invention is to provide a carbureter having a valve shaft bearing structure which, in spite of the fact that the carbureter body is made with a soft material such as a synthetic resin, does not develop impairment of functions of the choke valve and/or the throttle valve, and which would not easily develop vibratory movements of the choke valve and/or the throttle valve due to vibrations of the system.

These and other objects of the present invention will become more apparent during the course of the following detailed description and the appended claims.

DETAILED DESCRIPTION OF THE PREFERRED EMODIMENTS

The present invention will hereunder be described in further detail by giving reference to the embodiments illustrated.

Figure 1:
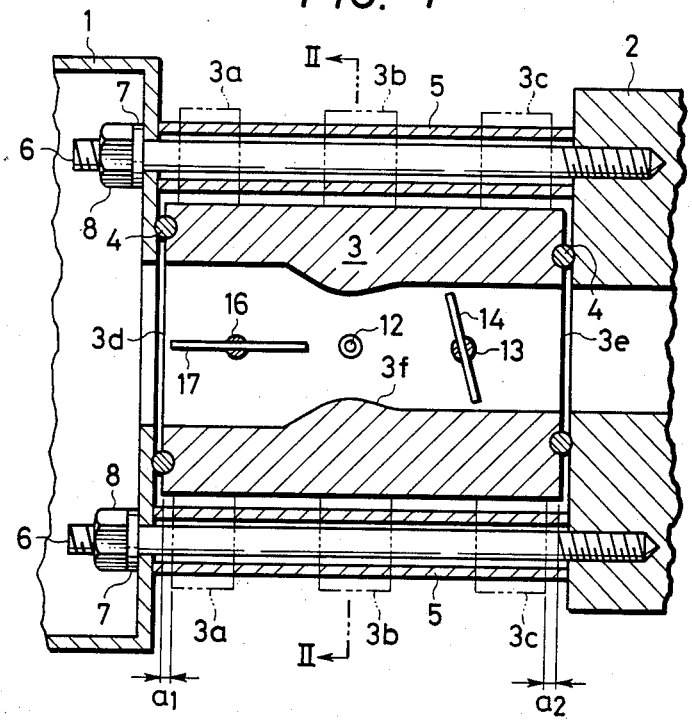
FIG. 1 is a diagrammatic horizontal sectional view of an embodiment of carbureter according to the present invention.
Figure 2:
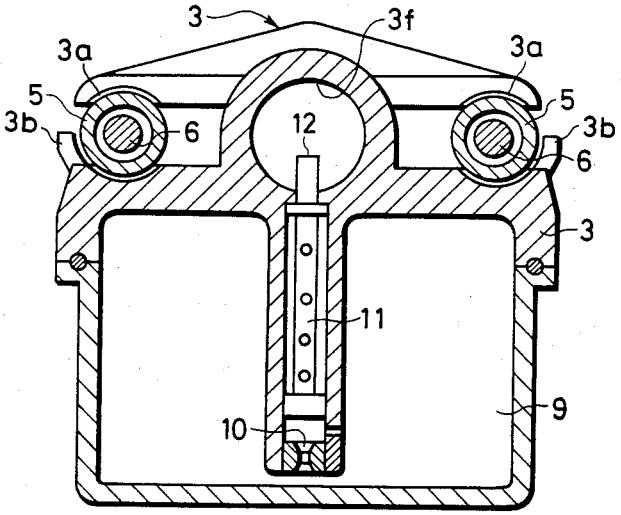
FIG. 2 is a sectional view taken along the line II—II in FIG. 1.

In FIGS. 1 and 2, to begin with, reference numeral 1 represents an air cleaner casing which is an upper-stream member; 2 a manifold pipe which is a down-stream member; 3 a carbureter body which is made of, for example, a synthetic resin and disposed between the air cleaner casing 1 and the manifold pipe 2 and having, in this embodiment, three arms 3*a*, 3*b* and 3*c* forming a pair, which arms extending laterally of the carbureter body so as to be positioned in a zig-zag fashion relative to each other on substantially diametrically opposite sides of the respective axial lines of the reinforcing members 5 which will be described later; 4 an elastic sealing member such as an O-ring made of rubber, one such O-ring being interposed between the air cleaner casing 1 and one end face of the carbureter body 3, and the other being interposed between the manifold pipe 2 and the other end face of the carbureter body 3; 5 a plurality of tubular reinforcing members disposed between the air cleaner casing 1 and the suction or manifold pipe 2 while being nipped in a zig-zag fashion between the three arms 3*a*, 3*b* and 3*c*, each of these reinforcing members having a length which is a little greater than the total length of the carbureter body 3 but slightly smaller than the combined length obtained by adding the length of the carbureter body 3 to the thicknesses of the two elastic sealing members of the carbureter body, and further having a rigidity greater than that of the carbureter body 3; 6 a plurality of insertion bolts such as stud bolts which are passed through the air cleaner casing 1 and also through the respective reinforcing members 5, with their one end screwed onto the suction or manifold pipe 2; 7 a washer mounted on the other end of the bolt, respectively; and 8 a nut screwed onto the other end of the insertion bolt, respectively.

Figure 3:
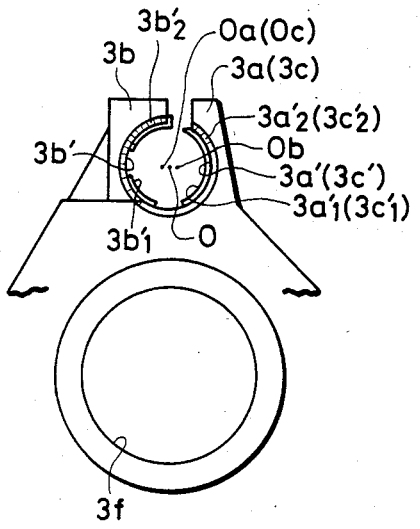
FIG. 3 is an enlarged side elevation of the arm for the attachment of a reinforcing member.
Figure 4:
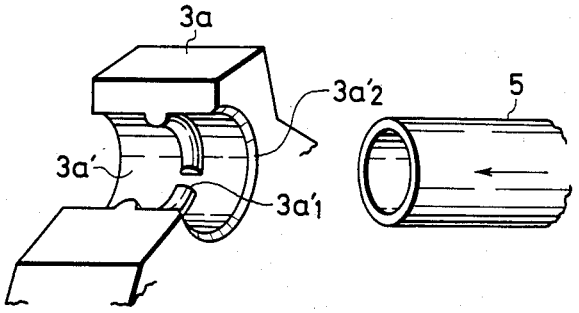
FIG. 4 is an enlarged perspective view of the arm for the attachment of the reinforcing member.

The arms 3*a* and 3*c* are positioned so as to leave distances $a_1$ and $a_2$ from the respective attachment end faces 3*d* and 3*e* of the carbureter body 3. The face of the arm (which is provided three, i.e. 3*a*, 3*b* and 3*c*, in number, but description will be made with respect to only one of them for the simplicity of explanation) which is brought into contact with the reinforcing member 5 presents a shape such as an arcuate recess 3*a'*, 3*b'*, 3*c'* to insure that its mating reinforcing member 5 will not make a substantial displacement toward the right side and the left side in FIG. 2, as will be noted easily in FIGS. 3 and 4. It should be noted here that the shape of this contact face is not limited to an arcuate shape throughout the entire contact surface region, but there may be provided locally a projecting piece $3a'_1$, $3b'_1$, $3c'_1$ or a chamfered inclined edge $3a'_2$, $3b'_2$, $3c'_2$ to facilitate an easy insertion of the reinforcing member 5 and to insure the surface to make only a partial contact with the mating reinforcing member 5 after its attachment to the carbureter body 3 is established. Also, as will be noted in FIG. 3, the center 0*a*, 0*b*, 0*c* of the arcuate formation of the recessed contact face of the arm 3*a*, 3*b*, 3*c* which is brought into contact with the reinforcing member 5 is displaced to a slight extent inwardly from the center 0 of its mating reinforcing member 5 which is attached to the carbureter body. As a result, the mating reinforcing member 5 is elastically nipped, and will be inhibited thereby to move when applied with a small amount of axial force and/or a slight vibration.

Figure 5:
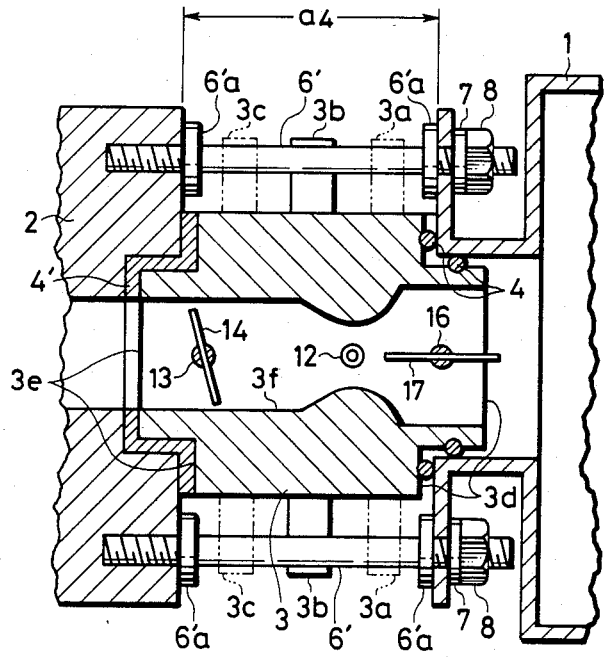
FIG. 5 is a horizontal sectional view showing another embodiment of carbureter of the present invention but having a different reinforcing member structure.

FIG. 5 shows a second embodiment of the present invention. This embodiment differs from the embodiment shown in FIG. 1 in that the opposite ends of the carbureter body 3 is fit into the air cleaner casing 1 and into the manifold pipe 2, respectively, and that an elastic sealing member 4' such as a rubber packing is interposed between the manifold pipe 2 and the end face 3*e* of the carbureter body 3, and further that stud bolt type reinforcing members are employed. More particularly, the stud bolt 6' which is used in this instant embodiment has the formation of a pair of flanges 6'*a*, 6'*a*. The distance between the respective outer faces of these flanges 6'*a*, 6'*a* is selected to satisfy those length requirements similar to those of the above-described tubular reinforcing member 5 of the first embodiment. In this instant embodiment, however, same washer 7 and bolt 8 as those in the first embodiment may be used.

Figure 6:
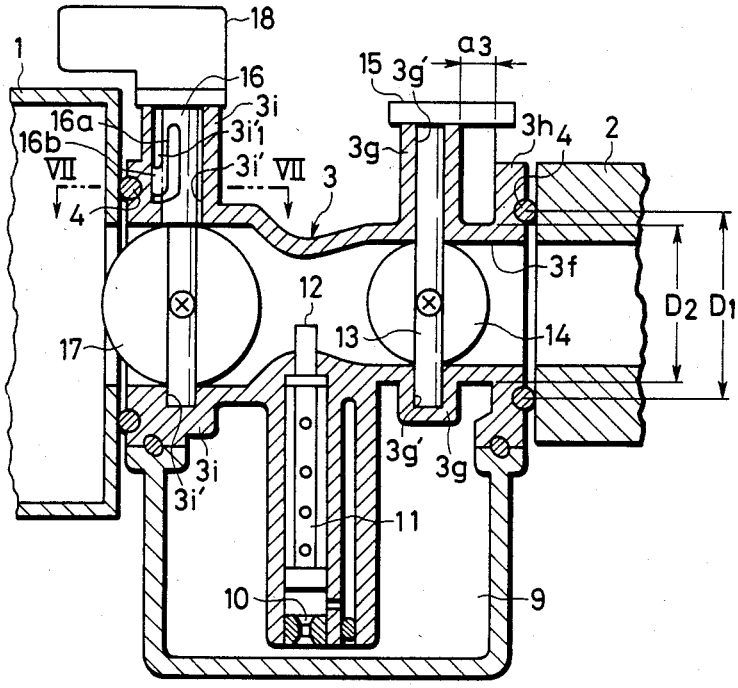
FIG. 6 is a vertical sectional view of the carbureter shown in FIG. 1.

Next, referring to FIG. 6, reference numeral 9 represents a float chamber; 10 a main jet; 11 an emulsion tube; 12 a main nozzle; 13 a throttle valve shaft formed integrally with the carbureter body 3 and rotatably supported by a shaft boss 3*g* having a shaft-bearing bore 3*g'* extending in a direction crossing at right angle the center axis of a suction bore 3*f*; 14 a throttle valve secured to the throttle valve shaft 13 within the suction bore 3*f*; 15 a throttle valve lever secured to the outward end of the throttle valve shaft 13. There is provided a clearance $a_3$ between the outer peripheral face of the shaft boss 3*g* and a partial flange 3*h* which is integrally formed at the end portion of the carbureter body 3 on its lower-stream side. Numeral 16 represents a choke valve shaft formed integrally with the carbureter body 3 and rotatably supported by a shaft boss 3*i* having a shaft-bearing bore 3*i'* extending in a direction crossing at right angle the center line of the suction bore 3*f*; 17 a choke valve secured to the choke valve shaft 16 within the suction bore 3*f*; and 18 a choke valve lever secured to the outer end of the choke valve shaft. As will be apparent from FIG. 6, the inner end of the shaft-bearing bore 3*i'* terminates at a position not reaching that radial position corresponding to the elastic sealing member 4. Also, a groove $3i'_1$ is provided on the inside face of that outer end portion of the longitudinally extending shaft-bearing bore 3*i'* which crosses the elastic sealing member 4. At that portion of the choke valve shaft 16 corresponding to this groove $3i'_1$, there is formed an arm 16*a* in the form of a cantilever by providing a groove in said specific portion. A projection 16*b* which is provided at the free end of this arm 16*a* is arranged to engage in the groove $3i'_1$. By this arrangement described above, it will be noted that, unless the choke valve shaft 16 is rotated purposely by operating the choke valve lever 18, the choke valve shaft 16 will be semi-fixedly held in its predetermined position, i.e. in its fully open position.

The carbureter according to the present invention is construction as described above. Therefore, by screwing the nut 8 tight in the state that the carbureter is about to be attached to the air cleaner casing 1 and to the manifold pipe 2, the carburetor body 3 will be fixed to the manifold pipe 2 together with the air cleaner casing 1. At such a time of attaching operation, it will be noted that, since the length of the reinforcing member 5 is slightly smaller than the length obtained by adding the thickness of the two sealing members 4, 4 to the length of the carbureter body 3 as described already, the final tightening of the nut 8 will serve to compress the elastic sealing members 4, 4. However, because the length of the reinforcing member 5 is greater than the total length of the carbureter body 3, it will be understood that, after the elastic sealing members 4, 4 have been compressed to such an extent as are able to hold air-tightness sufficiently, the fastening force given by the tightened nut will altogether be applied to the reinforcing member 5, so that no excessively great force will be loaded onto the carbureter body 3. Accordingly, even when there are some dimensional variance present in each constitutional member of the system as a result of manufacturing error, there is no fear whatsoever that the functional effect of the reinforcing member 5 is reduced due to an excessive force acting upon the carbureter body 3. This good advantage can be expected in perfectly the same way here also as in the embodiment of FIG. 5 because of the arrangement that the length $a_4$ between the outermost side faces of the paired flanges 6'a, 6'a of the reinforcing member 6' is slightly smaller than the length obtained by adding the length of the carbureter body 3 to the thicknesses of the two elastic sealing members 4, 4'.

Also, at the time that the carbureter is attached, the reinforcing member 5 is inserted between the arms 3a, 3b, 3c, so that the reinforcing member 5 is elastically nipped between these arms 3a, 3b, 3c and accordingly the reinforcing member 5 is prevented irom coming off the system. As a result, the operation of attaching the carbureter becomes very easy. Also, the attachment end faces 3d and 3e of the carbureter body 3 are comprised of only those portions each having a relatively small area sufficient for supporting the elastic sealing members 4, 4 as shown in FIG. 1, and also owing to the fact that these elastic sealing members 4, 4 are interposed, there arises no direct contact between the respective attachment faces of both the air cleaner casing 1 and the manifold pipe 2 and the opposite end faces 3d, 3e of the carbureter body 3. Accordingly, there occurs no heat conduction directly through the large attachment end faces of the conventional system, nor does there develop any transmission of mechanical vibrations as have taken place in such conventional systems. Thus, adverse effects due to the heat from the engine and the surging at the surface of the liquid contained in the float chamber caused by vibrations of the system can be prevented. Also, because of the fact that the areas of contact faces of the arms 3a, 3b, 3c against the reinforcing member 5 are small as described above, substantially the entire surfaces of the reinforcing member 5 are in the state of being exposed. As a result, the radiation of heat from the manifold pipe 2 is performed effectively, and thus adverse effects due to the heat coming from the engine can be prevented all the more efficiently and effectively.

Figure 7:
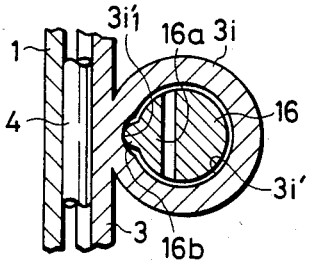
FIG. 7 is a sectional view taken along the line VII—VII in FIG. 6.

Furthermore, as will be clear from the description made above in connection with FIGS. 6 and 7, it will be noted that, in the structure of the supporting portion of the throttle valve shaft 13, there is provided a small clearance $a_3$ between the flange 3h which supports the elastic sealing member 4 and the shaft boss 3g, and also that the diameter $D_1$ of the elastic sealing member 4 is made to be greater than the outer diameter $D_2$ of the suction bore 3f, and further that, therefore, the fastening force exerted by the insertion bolt 6 will hardly act upon the shaft boss 3g. This arrangement serves so that the shaft-bearing bore 3g' will not develop distortion, with the result that there arises no mal-function thereof. Also, because of this absence of distortion, there is no need to form the shaft-bearing bore 3g' to have a substantially large size, and thus the throttle valve shaft 13 will not develop a play, and its resistance to vibration will improve accordingly. Not only that, in the shaft-bearing portion of the choke valve shaft portion 16, the inner portion of the shaft-bearing bore 3i' is provided at a location outside the extension line of the direction of the force applied to the elastic sealing member 4; so that there develops no distortion in this shaft-bearing portion, with the result that there occurs no poor operation, and also the resistance of this portion to vibration will improve. Furthermore, in that portion of the choke valve shaft 16 at which it is inserted in the outer shaft-bearing bore portion, there is formed a fitting groove to thereby provide an elastic arm portion 16a. Accordingly, even in the event that the outer shaft-bearing bore portion 3i' happens to be located on the extension line of the force applied to the elastic sealing member 4, and that, as a result, when there is developed a distortion in said shaft-bearing bore portion, the elastic arm portion 16a will develop warping in accordance with the distortion, so that the system will develop no mal-function. Also, by the elasticity of the elastic arm portion 16a, the choke shaft 16 is rendered to the state that its surface is normally pressed against the inner surface of the shaft-bearing bore 3i', so that the choke valve shaft 16 will not develop a play, and accordingly its resistivity to vibration will improve. Moreover, arrangement is provided that a projection 16b which is provided on the elastic arm 16a engages a groove $3i'_1$ of the shaft-bearing bore 3i', and thus the choke valve shaft 16 is semi-fixed at a predetermined position which is, for example, the valve's fully-open position. Therefore, it is possible to construct the choke valve shaft bearing portion having a semi-fixing function into a compact size.

Figure 8:
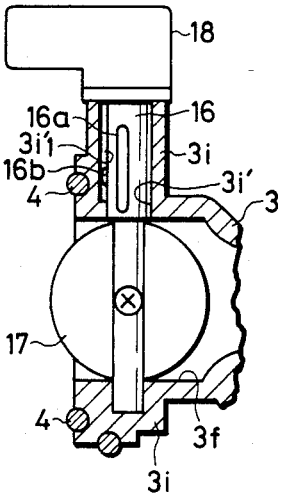
FIG. 8 is a partial sectional view showing an embodiment of the choke shaft bearing portion which is different from that shown in FIG. 6.

FIG. 8 shows a further embodiment wherein the above-mentioned semi-fixing mechanism is adopted in a choke valve shaft bearing portion. It should be noted here that, in this instant embodiment, the elastic arm portion 16a is constructed in the form of a double-end beam. The remainder of the structure and the functions of this instant embodiment are similar to those already described above. Accordingly, parts and members having functions same as those of FIG. 6 are given the same reference numerals as for those of FIG. 6, and their explanation is omitted.

In the embodiments described above, the elastic sealing member 4 is provided at both end faces of the carbureter body. This elastic sealing member 4 may, instead, be interposed only between the manifold pipe 2 and the carbureter body 3. Also, the reinforcing member may be made of such a material as metal, hard synthetic resin or ceramics. The insertion bolt 6 is not limited to a stud type bolt, but it may be just an ordinary bolt. Furthermore, in the above-described embodiments, the reinforcing member has been shown to have a solid round cross section. In case, however, the reinforcing member is comprised of a tube or a cylinder, this member may have a polygonal or C-shaped cross section. And, in case the reinforcing member is of a stud-bolt type, it may have a polygonal cross section.

What is claimed is:

1. A carbureter for an internal combustion engine and made of a soft material, comprising:

a body having a first end face to be coupled to a manifold pipe via an elastic sealing member, and a second end face to be coupled to an air cleaner via an elastic sealing member;

a suction bore formed through said body between said first end face and said second end face;

a throttle valve shaft rotatably supported within said body across said suction bore;

a choke valve shaft rotatably supported within said body across said suction bore;

a reinforcing member having a high rigidity and having a length greater than the distance between said first end face and said second end face but smaller than the length obtained by adding said distance to thickness of said sealing members of said carbureter body; and a plurality of arms provided in a zig-zag fashion at intervals relative to each other and located on both sides of axial line of said reinforcing member to nip said reinforcing member elastically in its posture of being placed along said suction bore.

2. A carbureter according to claim 1, in which:

said plurality of arms project in pairs from external surface of said carbureter body to extend outwardly of said suction bore in a direction of diameter of this bore.

3. A carbureter according to claim 1, in which:

said plurality of arms each has a face to contact said reinforcing member, and this contacting face is formed as a recessed face.

4. A carbureter according to claim 3, in which:

said recessed face has a projection formed thereon.

5. A carbureter according to claim 3, in which:

a boundary region between said recessed face of said arm and its adjacent side face is formed as a tapered region progressively narrowed as it goes toward said recessed face.

6. A carbureter according to claim 1, in which:

said reinforcing member is formed as a pipe made of either a metal, a hard synthetic resin or ceramics.

7. A carbureter according to claim 1, in which:

said reinforcing member is formed as a bolt made of either a metal, a hard synthetic resin or ceramics.

8. A carbureter according to claim 1, in which:

an appropriate gap is provided between said first end face and a shaft-bearing boss for said throttle valve shaft and also between said second end face and a shaft-bearing boss for said choke valve shaft, and said elastic sealing member has a diameter greater than the outer diameter of said suction bore.

9. A carbureter according to claim 1, in which:

the shaft-bearing bore for said throttle valve shaft is positioned to insure that a force which is to be applied to said elastic sealing member does not act upon the carbureter body.

10. A carbureter according to claim 1, in which:

a groove is provided locally in said choke valve shaft to extend longitudinally of said choke valve shaft to thereby provide a flexible means having an outwardly extending projection, and a groove is provided in the inner face of the shaft-bearing bore for said choke valve shaft so as to extend longitudinally of said choke valve shaft and to engage the abovesaid projection, whereby to allow said choke valve shaft to be semi-fixed at a predetermined position.

11. A carbureter according to claim 1, in which:

an elastic sealing member is adapted to be interposed also between said second end face and said air cleaner to couple said carbureter in its floating state between said air cleaner and said manifold pipe.

* * * * *